US005308231A

United States Patent [19]

Bookbinder et al.

[11] Patent Number: 5,308,231

[45] Date of Patent: May 3, 1994

[54] SCROLL COMPRESSOR LUBRICATION

[75] Inventors: Mark J. Bookbinder, Detroit, Mich.; Chrisotpher M. Bellinger, Lockport, N.Y.; Dwayne L. Johnson, La Crescent, Minn.;

[73] Assignee: General Motors Corporation, Detroit, Mich.

[21] Appl. No.: 58,856

[22] Filed: May 10, 1993

[51] Int. Cl.[5] ..... F01K 1/02

[52] U.S. Cl. ..... 418/55.6; 418/55.5; 418/94

[58] Field of Search ..... 418/55.6, 55.5, 91, 418/94, 98

[56] References Cited

U.S. PATENT DOCUMENTS

| | | | |
|---|---|---|---|
| 4,484,869 | 11/1984 | Nakayama et al. | 418/55 |
| 4,547,138 | 10/1985 | Mabe et al. | 418/55 |
| 4,555,224 | 11/1985 | Hazaki et al. | 418/55 |
| 4,568,256 | 2/1986 | Blain | 418/55 |
| 4,932.845 | 6/1990 | Kikuchi et al. | 417/371 |
| 4,936,756 | 6/1990 | Shimizu et al. | 417/371 |
| 4,940,396 | 7/1990 | Schimizu et al. | 417/410 |
| 5,201,646 | 4/1993 | Dees et al. | 418/55.5 |

FOREIGN PATENT DOCUMENTS

| | | | |
|---|---|---|---|
| 0226587 | 10/1986 | Japan | 418/55.6 |

*Primary Examiner*—Richard A. Bertsch
*Assistant Examiner*—Charles G. Freay
*Attorney, Agent, or Firm*—Patrick M. Griffin

[57] ABSTRACT

The scroll compressor 10 includes a housing 12. A fixed scroll 18, with an end plate 20, a spiral wrap 22 and a discharge aperture 90, is an integral part of the rear section 16 of the housing. An orbital scroll 24, including an end plate 26 and a spiral wrap 28, cooperates with the fixed scroll 18 to form sealed fluid pockets 38 and 40. An axial thrust and rotation prevention assembly 46 allows orbital motion, prevents rotation of the orbital scroll 24 and limits axial movement of the orbital scroll 24 away from the fixed scroll 18. The orbital scroll 24 is driven to move the fluid pockets 38 and 40 toward the center of the scrolls, and compress fluid in the pockets. The drive for the orbital scroll 24 includes a crankshaft 74 with a crank pin 78 journaled in the housing 12. An eccentric bushing 80 is journaled by a bearing 81 in a boss 82 on the orbital scroll 24. The crank pin 78 passes through a bore 87 in the eccentric bushing 80 to rotate the bushing. A lubrication passage 94 is provided through the crank pin 78 to allow fluid and entrained lubricant in the crankcase 100 to pass from the crankcase 100 to the cavity 96 and then through the bearing 81. A scoop 108 on the inlet end of the passage 94 will pick up lubricant from the crankcase.

1 Claim, 4 Drawing Sheets

SCROLL COMPRESSOR LUBRICATION

TECHNICAL FIELD

The invention relates to a fluid displacement apparatus and more particularly to a scroll type compressor. Scroll type compressors are commonly used to compress refrigerant in stationary and mobil air conditioning systems.

BACKGROUND OF THE INVENTION

Scroll type compressors with one stationary or fixed scroll and one orbiting scroll are well known. Scrolls in these compressors have parallel end plates and involute spiral wrap elements of like pitch. The wrap of one scroll makes line contacts with the wrap of the other scroll and also contacts the adjacent end plate to define fluid pockets. As the orbital scroll orbits relative to the fixed scroll, the locations of the contact lines move along the surfaces of the wraps toward the center of the scrolls, the pockets decrease in size compressing the fluid contained in the pockets and the fluid is moved toward the center of the scrolls. A scroll discharge aperture is provided near the center of the fixed scroll to allow compressed fluid to pass from the scrolls into an exhaust cavity. The exhaust cavity is connected to a fluid discharge opening in the compressor housing.

The compressed fluid in the scroll pockets exerts a force on the scroll end plates which tends to separate the end plates. If the scrolls separate too much, the scroll wraps and scroll tip seals will not form a seal with the surface of the end plate of the adjacent scroll. Compressed fluid in one pocket can then move to another fluid pocket that has a lower pressure. An axial thrust assembly is employed to limit axial separation of the scrolls and thereby keep the fluid pockets sealed and maintain compressor efficiency. one common axial thrust assembly includes a plurality of balls in a space between facing surfaces on the compressor housing and on the orbital scroll end plate. These balls transmit the force, exerted on the orbital scroll by compressed fluid in the scroll pockets, from the orbital scroll end plate to the compressor housing and limit axial movement of the scrolls relative to each other.

An anti-rotation assembly is provided to prevent rotation of the orbital scroll. The assembly may include a first ring with a series of apertures that each surround one of the balls and a second ring, identical to the first, that also receives the balls in its apertures. The first ring is fixed to the compressor housing and the second ring is fixed to the orbital scroll. The apertures in the two rings have a diameter which will permit orbital movement of the balls and the orbital scroll and prevent rotation of the orbital scroll.

The compressor drive includes a crankshaft rotatably journaled in the compressor housing. An eccentric bushing is journaled on the crankshaft crank pin. The eccentric bushing is also received in a bore in a boss on the forward wall of the orbital scroll end plate. A bearing is provided in the bore in the boss to allow free rotation of the eccentric bushing relative to the orbital scroll. Scroll compressors are lubricated by lubricant entrained in the fluid they compress. In some designs parts needing lubrication are merely exposed to fluid with entrained lubricant. In other designs lubricant is separated from the fluid and then moved to the parts requiring lubrication.

Lubrication of the eccentric bushing which connects the crankshaft to the orbital scroll is a problem in some compressors. During prolonged high speed operation the bearing which supports the eccentric bushing on the orbital scroll may fail. The journal connecting the eccentric bushing to the crankshaft may also experience rapid wear.

SUMMARY OF THE INVENTION

The primary object of the invention is to provide a scroll compressor lubrication system which lubricates the moving parts.

A further object of the invention is to lubricate a scroll compressor by providing access to parts requiring lubrication by fluid to be compressed and lubricant entrained with the fluid.

Another objective of the invention is to provide passages for fluid to be compressed which will allow the fluid to carry lubricant to the orbital scroll drive.

The scroll compressor employing the lubrication system of this invention includes a housing with a front section and a rear section. A fixed scroll with a flat end plate and an involute wrap is mounted in the rear section of the housing. An orbital scroll with a flat end plate and an involute wrap is positioned inside the housing in an angularly and radially offset position relative to the fixed scroll to form at least one pair of fluid pockets. An orbital scroll drive assembly orbits the orbital scroll relative to the fixed scroll so that the fluid pockets move toward the center of the scrolls, become smaller and compress the fluid in the pockets.

An axial thrust and rotation prevention assembly is mounted in the front section of the housing. The assembly includes a plurality of balls which axially position the orbital scroll relative to the fixed scroll to maintain a seal between the axial end surface of each wrap and the flat end plate of the adjacent scroll. The balls which provide an axial thrust load on the orbital scroll are each positioned in one of the apertures in a ring attached to the front section of the housing and a ring attached to the orbital scroll. The apertures in the two rings have the proper diameter relative to the balls and the radius of the orbital scroll orbit to permit orbital movement of the orbital scroll and to prevent rotation of the orbital scroll.

The orbital scroll drive assembly includes a crankshaft journaled in the front section of the scroll housing. An eccentric bushing is pivotally attached to the crankshaft crank pin. The eccentric bushing is also rotatably journaled in a boss on the end plate of the orbital scroll. The front side of the orbital scroll end plate, the axial thrust rotation prevention assembly and a portion of the crankshaft are in an area of the housing that is in communication with the fluid inlet.

The lubrication system includes a passage through the crank pin of the crankshaft. This passage provides communication between the inside of the boss on the orbital scroll and areas in the housing that are in communication with the compressor inlet. A scoop can be provided on the forward end of the crank pin to pick up fluid and entrained lubricant. The scoop will force fluid and entrained lubricant into the boss on the orbital scroll and into the bearing the eccentric bushing is mounted in.

An alternative to the scoop is a small passage through the end plate of the orbital scroll that will permit compressed fluid and entrained lubricant at an intermediate pressure to flow from the fluid pockets to the inside of the boss on the orbital scroll. Excess fluid can pass through the passage in the crank pin and into the compressor housing. Radial passages in the crank pin will allow lubricant to flow into the journal connecting the crank pin to the eccentric bushing. The passages will pass lubricant to the crank pin and bushing journal regardless of the location of entry into the crank pin passage.

The forgoing and other objects, features and advantages of the present invention will become more apparent in the light of the following detailed description of exemplary embodiments thereof, as illustrated in the accompanying drawing.

DETAILED DESCRIPTION OF THE INVENTION

Figure 1:
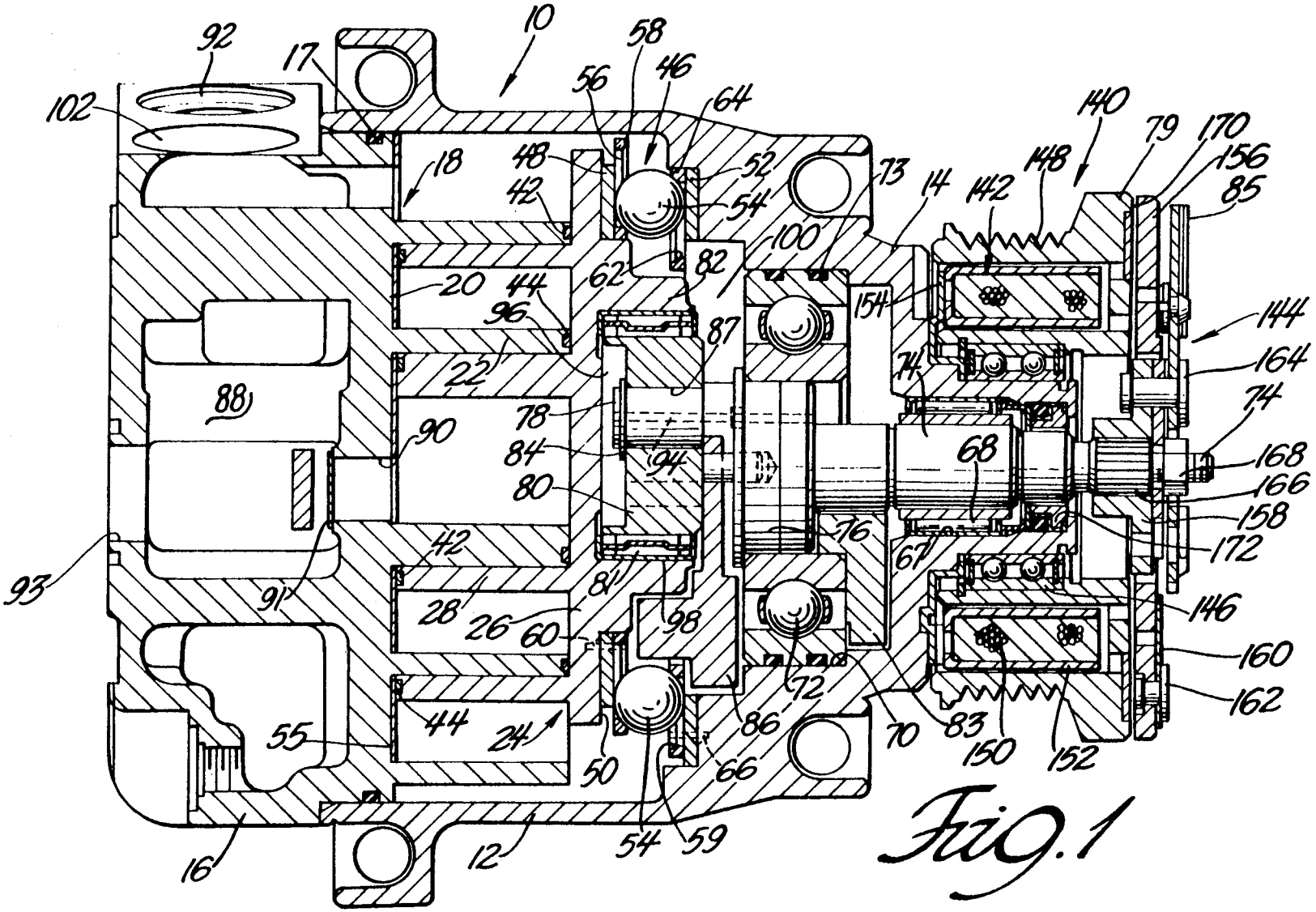
FIG. 1 is a vertical sectional view of a scroll compressor with the lubrication system of this invention.

The scroll type compressor 10 as shown in FIG. 1 includes a housing 12 with a front section 14 and a rear section 16. The two sections are held together by bolts that are not shown. The housing 12 is sealed by a seal 17 at the connection between the front section 14 and the rear section 16.

Figure 4:
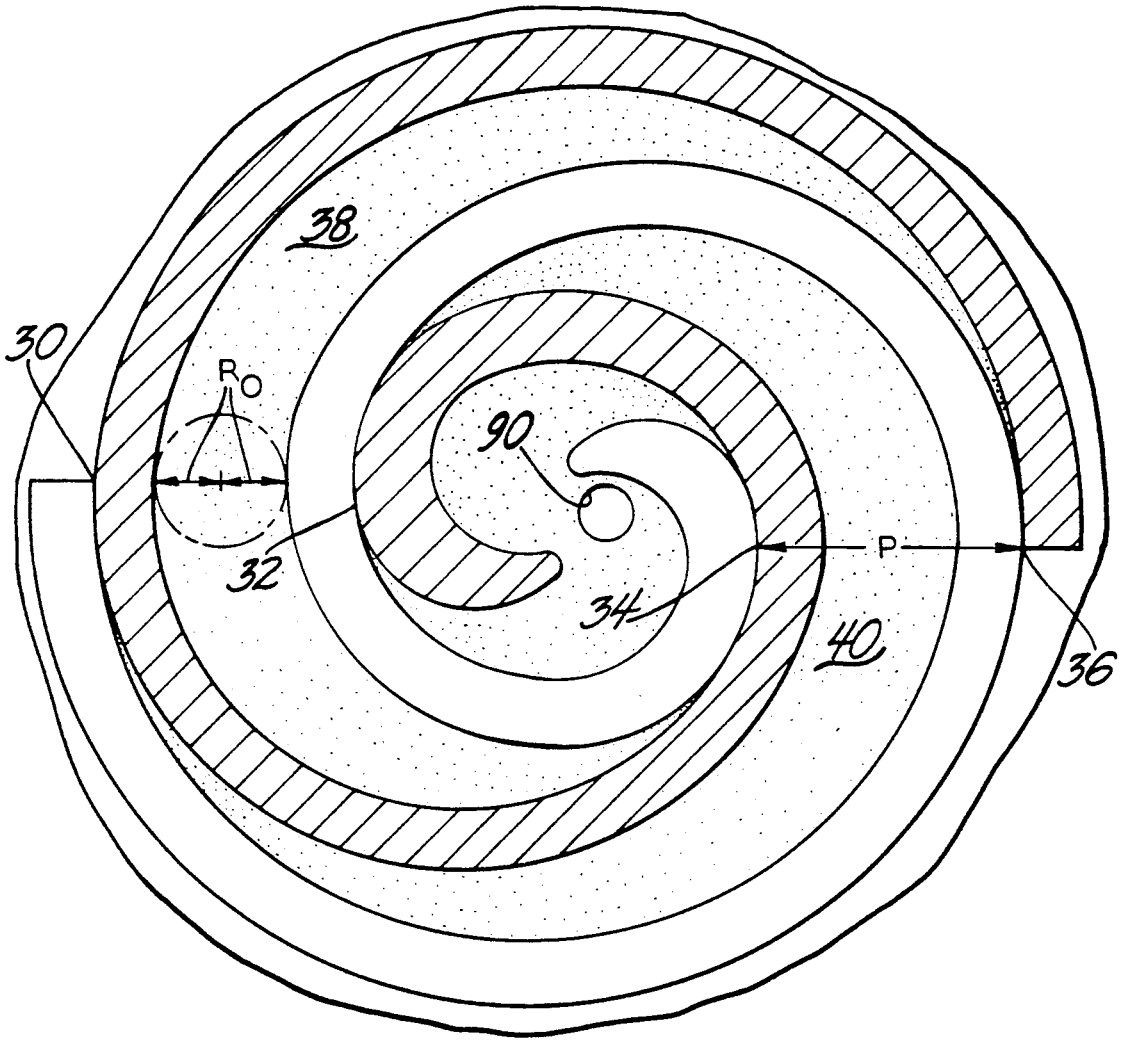
FIG. 4 is an enlarged sectional view illustrating the spiral elements of the fixed and orbiting scrolls of the compressor shown in FIG. 1.

A fixed scroll 18, as shown in FIG. 1, is an integral part of the rear section 16 of the housing 12. The fixed scroll 18 includes a flat end plate 20 and an involute spiral wrap 22. An orbital scroll 24 is positioned within the housing 12 to cooperate with the fixed scroll 18. The orbital scroll 24 includes a flat end plate 26 and an involute spiral wrap 28. The wrap side surface of the flat end plate 20 is parallel to the wrap side surface of the end plate 26. The wrap 22 of fixed scroll 18 has the same pitch P as the wrap 28 of orbital scroll 24. The wraps 22 and 28 are in contact with each other along lines perpendicular to the flat end plates 20 and 26. The locations of the contact lines 30, 32, 34 and 36 when the scrolls are in one position relative to each other, are shown in FIG. 4. The contacts between the involute spiral wraps 22 and 28 form sealed pockets 38 and 40. When the orbital scroll 24 orbits in a counter clockwise direction, as seen in FIG. 4, the contact lines 30, 32, 34 and 36 move counter clockwise along the surfaces of the involute spiral wraps 22 and 28 and the sealed pockets 38 and 40 move toward the center of the scrolls 18 and 24. As the sealed pockets 38 and 40 move toward the center of the scrolls 18 and 24 the pockets become smaller and the fluid in the sealed pockets is compressed.

Figure 3:
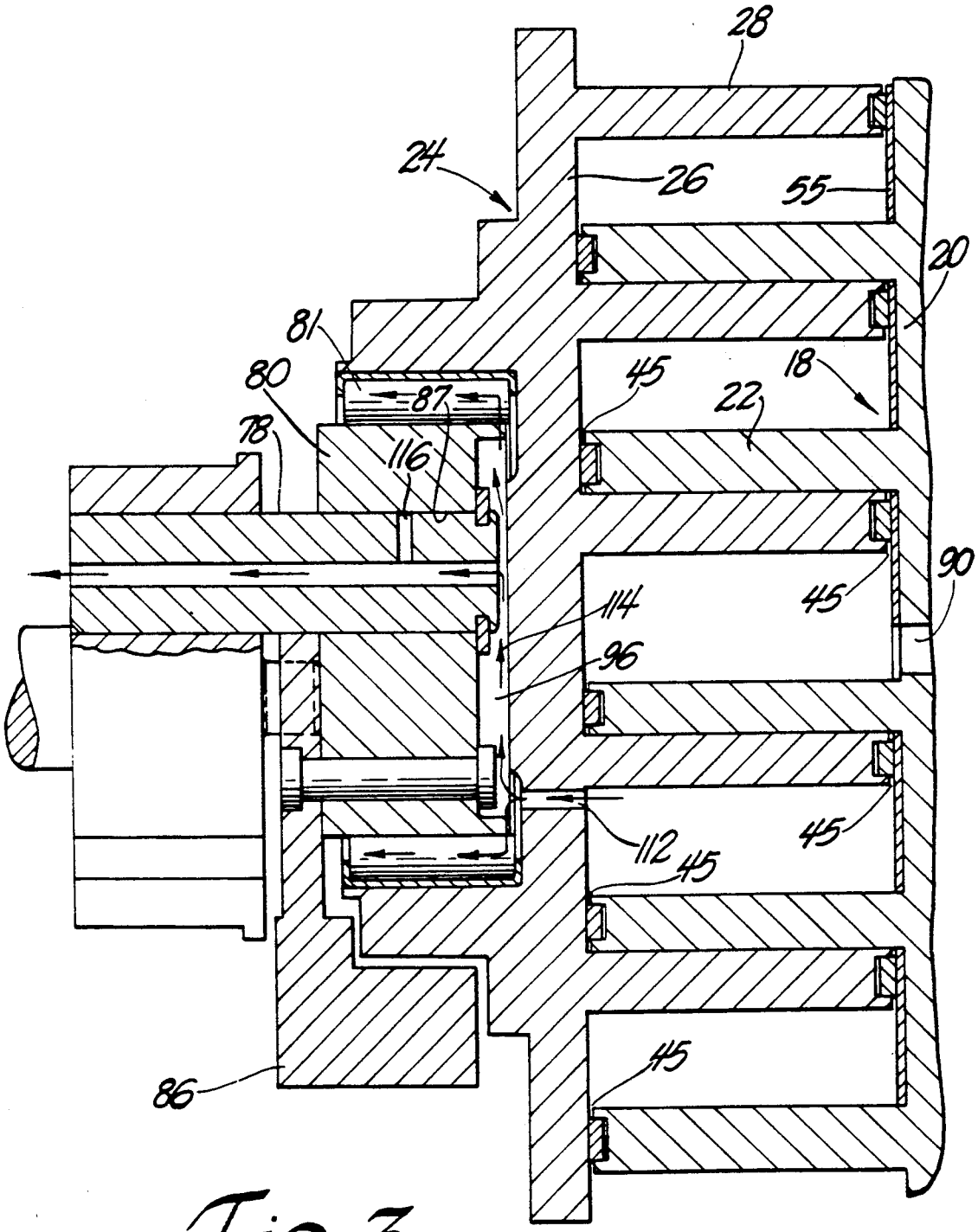
FIG. 3 is a sectional view similar to FIG. 2 with a passage through the orbital scroll end plate.

A fixed gap 45, shown exaggerated in FIG. 3, is maintained at assembly of the involutes to prevent thrust loading of the axial end surfaces of each spiral wrap 22 and 28 by the end plates 20 and 26 during compressor operation due to thermal expansion. Gas pressure sealing is achieved by fitting seals 42 in grooves 44 in the axial end surfaces of each involute spiral wrap 22 and 28. Gas pressure is allowed to fill the space between seals 42 and grooves 44 to keep the seals 42 in sealing contact with the end plates 20 and 26. This pressure extends the seals from grooves 44 pushing them into contact with the end plates. The axial gas load exerted on the orbiting scroll 24 is restrained by a thrust and rotation prevention assembly 46. This assembly limits axial separation of the scrolls to limit the maximum gap 45 and prevents over extension of the seals 42 from the grooves 46. The axial thrust and rotation prevention assembly 46 includes a flat ring race 48 secured to a forward surface 50 of the orbital scroll 24, and a flat ring race 52 secured to front section 14 of the housing 12. A number of balls 54 are provided between the flat ring races 48 and 52. At least three balls 54 are required. It is common to employ about sixteen balls 54 in each axial thrust and rotation prevention assembly 46. The axial thrust load due to fluid in the sealed pockets 38 and 40 is exerted on the flat end plate 26 of the orbital scroll 24. The axial thrust load is also exerted on the flat ring race 48, the balls 54, a flat ring race 52 and the front section 14 of the housing. The balls 54 and the flat ring races 48 and 52 limit axial movement of the orbital scroll 24 relative to the fixed scroll 18 and keep the seals 42 from over extension from the grooves 44 and in contact with the flat end plates 20 and 26.

The orbital scroll 24 including the flat end plate 26 is an anodized aluminum alloy. The seal 42 slides along the surface of the flat end plate 26 during operation. Wear on the anodized flat end plate 26 is minimal. The flat end plate 20 of the fixed scroll 18 is not anodized. An anti-wear plate 55 may be attached to the fixed scroll 18 as part of the flat end plate 20. The seal 42 in the groove 44 in the involute spiral wraps 28 is in sealing contact with the anti-wear plate 55.

The balls 54 are each in an aperture 56 in a ring 58 secured to the flat end plate 26 of the orbital scroll 24 by pins 60. The balls 54 are also each in an aperture 62 in a ring 64 secured to the compressor housing 12 by pins 66. The apertures 56 in the ring 58 and the apertures 62 in ring 64 are the same diameter. The diameter of the apertures 56 and 62 are sufficient to permit orbital movement of the orbital scroll 24 in a path that will maintain contact between the involute spiral wraps 22 and 28. The balls 54 cooperate with the walls of the apertures 56 and 62 in the rings 58 and 64 to prevent rotation of the orbital scroll 24.

The apertures 56 and 62, in the rings 58 and 64, have chamfers 59 at the ends of the apertures that are facing the balls 54. The chamfers 59 provide a ball contact surface which limits wear on the balls 54 and on rings 58 and 64. The surface of the chamfers 59 are the portions of the walls of the apertures 56 and 62 which contact the balls 54 and prevent rotation of the orbital scroll 24.

Figure 2:
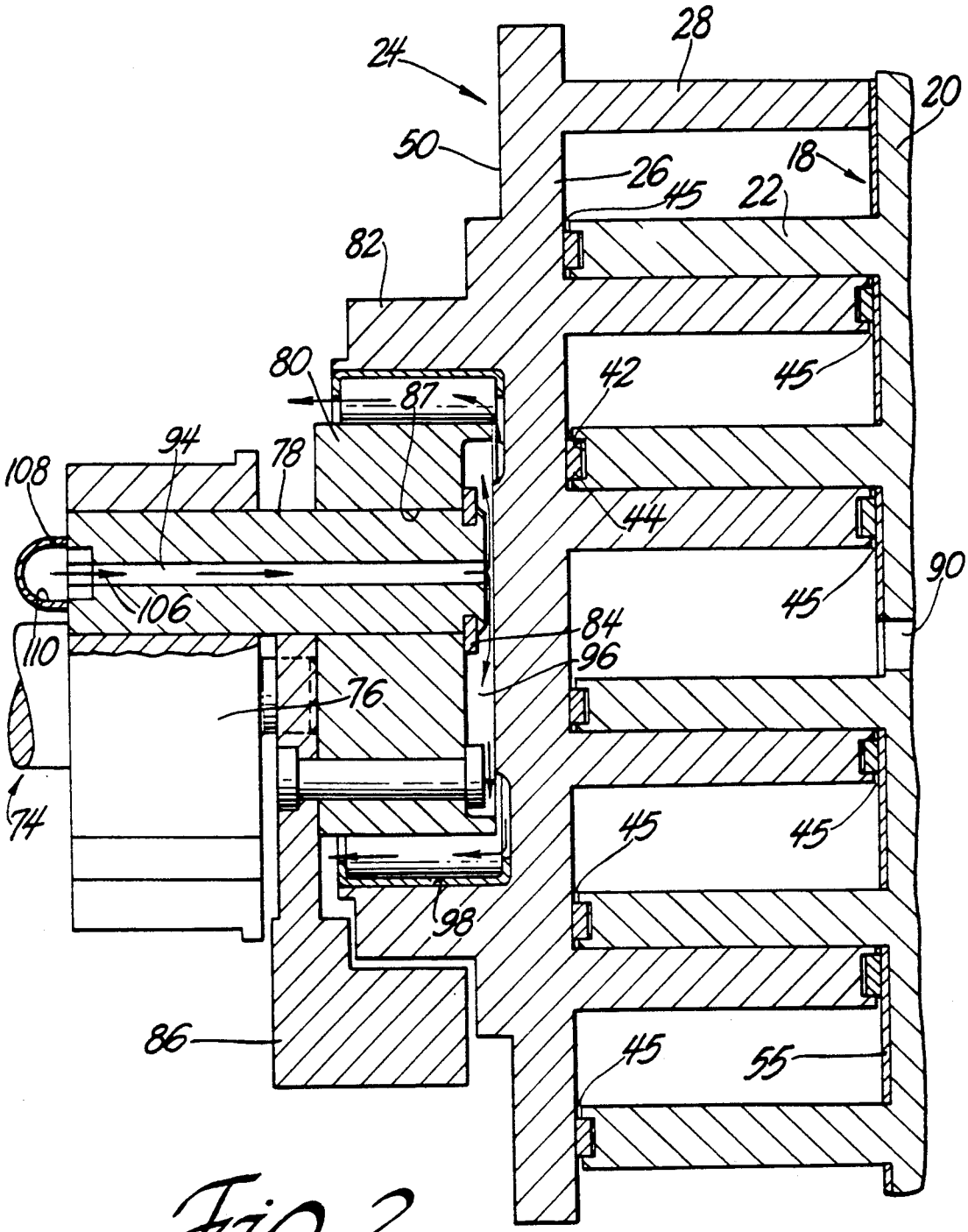
FIG. 2 is an enlarged sectional view of the orbital scroll, a portion of the fixed scroll and a portion of the scroll drive assembly with a scoop attached to the forward end of the crank pin.

The front section 14 of the housing 12 includes a bore 67 for bearing 68 and a bore 70 for bearing 72. Two bands 73 on the bearing 72 hold the bearing in the bore 70 if the front section 14 of the housing 12 expands more than the bearing at elevated temperatures. The bores 67 and 70 are co-axial. A crankshaft 74 with an integral disk 76 is rotatably journaled in the housing 12 by the bearings 68 and 72. A crank pin 78, as shown in FIG. 1 is an integral part of the disk 76 and the crankshaft 74. The crank pin 78 can also be a pipe member pressed into a bore in the disk 76, as shown in FIGS. 2 and 3. An end of the crankshaft 74 extends outside the compressor housing and is driven by an electromagnetic clutch 140. The electromagnetic clutch 140 includes a belt pulley 79 or other drive means, a coil assembly 142 and an armature assembly 144. The belt pulley 79 is journaled on the front section 14 of the housing 12 by a bearing 146. A plurality of V-shaped grooves 148 on the belt pulley 79, as shown, are for engagement with a power band belt. The coil assembly 142 includes a toroidal coil 150 inside a coil support ring 152 with a U-shaped cross section. The coil support ring 152 is supported in a fixed position inside a recess in the belt pulley 79 by support bracket 154. The armature assembly 144 includes an armature 15-6 attached to a hub 158 by spring strips 160 and rivets 162 and 164. The hub 158 has splines which engage splines 166 on the crankshaft 74. A nut 168 clamps the hub 158 on the crankshaft 74. When the toroidal coil is connected to a current source and energized, magnetic force deflects the spring strips 160 and moves the armature 156 into contact with the contact surface 170 on the belt pulley 79. When the armature 156 is in contact with the contact surface 170 torque is transferred from the belt pulley 79 to the crankshaft 74. A balance weight 85 is attached to and rotates with the integral disk 76. A balance weight 85 is attached to a portion of the belt pulley 79.

An eccentric bushing 80 is rotatably journaled by a needle bearing 81 in a boss 82 on the forward surface 50 of the orbital scroll 24. The crank pin 78 passes through a bore 87 in the eccentric bushing 80. A retainer clip 84 secures the bushing so to the crank pin 78. A balance weight 86 is secured to the eccentric bushing 80.

The rear section 16 of the compressor 12 includes an integral exhaust cavity 88. A scroll discharge aperture 90 is provided in the center portion of the flat end plate 20 for the passage of compressed fluid from the scrolls 18 and 24 and into the exhaust cavity 88. Compressed fluid passes through a reed valve 91 as it leaves the discharge aperture 90. Compressed fluid passes from the exhaust cavity 88 through a passage, which is not shown, and exits the housing 12 through outlet port 92. An opening 93 is provided for installation of the reed valve 91. The opening 93 would normally be closed by a cover plate. However, the opening 93 could be used as an outlet port and the outlet port 92 could be closed.

The crank pin 78 includes a central lubrication passage 94. This lubrication passage 94 provides communication between the cavity 96, formed by a bore 98 in the boss 82 and closed by the eccentric bushing 80, and the housing crank case 100. The crank case 100 includes the portion of the housing 12 which encloses the axial thrust and rotation prevention assembly 46, the rear portion of the crankshaft 74 the forward surface 50 on the flat end plate 26 of the orbital scroll 24, the bearing 72, the balance weight 83 and the bearing 68. The forward portion of the crankcase 100 is closed by a seal assembly 172. Fluid and entrained lubricant enter the compressor and the crank case 100 through housing inlet port 102.

Centrifugal force due to rotation of the crankshaft 74 will tend to force lubricant in the cavity 96 toward the walls of the bore 98 and out of the cavity through the needle bearing 81. This movement of lubricant will tend to suck fluid and entrained lubricant in the forward end of the lubrication passage 94. The flow of fluid and lubricant is indicated by arrows 106 in FIG. 2.

Fluid which is to be compressed and entrained lubricant can be forced into the lubrication passage 94 by a scoop 108. The scoop 108 is attached to the forward end of the crank pin 78, as shown in FIG. 2. If the crank pin 78 is integral with the integral disk 76, as shown in FIG. 1, the scoop 108 is attached to the disk over the lubrication passage. The scoop 108 encloses the entrance to the lubrication passage 94 except for an opening 110 on one side facing in the direction of rotation.

The eccentric bushing 80 and the needle bearing 81 can also receive lubrication from a passage 112 through the end plate 26 of the orbital scroll 24 as shown in FIG. 3. The passage 112 allows fluid and entrained lubricant to pass from a pocket 38 or 40 and into the cavity 96. The fluid and entrained lubricant which pass through the passage 112 is compressed to an intermediate pressure. The pressure can be increased, if necessary by placing the passage 112 closer to the center of the orbital scroll 24 where there is maximum compression. The pressure can be decreased by placing the passage 112 closer to the radially outer edge of the orbital scroll 24 where the pressure in the scroll pockets is slightly above fluid inlet pressure. The quantity of lubricant entering the cavity 96 will depend upon the pressure at the inlet end of the passage 112, the size of the passage and other factors.

Flow of fluid and entrained lubricant through the passage 112 will stop one time during each orbit of the orbital scroll when the passage 112 is covered by the seal 42. By placing the passage 112 adjacent to the wrap 28, the seal 42 will scrape lubricant from the end plate 26 to the passage entrance. The quantity of lubricant passing through the passage 112 could be decreased, if desired, by moving the passage 112 away from the wrap 28.

The fluid and entrained lubricant entering the cavity 96 through the passage 112 is subjected to centrifugal force as a result of rotation of the crankshaft 74 and the eccentric bushing 80 and orbital movement of the orbital scroll 24. This orbital movement of the orbital scroll 24 will result in a portion of the lubricant entering the cavity 96 being separated from the fluid and passing through the needle bearing 81. At least some of the fluid entering the cavity 96 and a portion of the entrained lubricant will exit the cavity 96 through the lubrication passage 94.

The fluid which enters lubrication passage 94 from the forward end as shown in FIG. 2 or the rear end as shown in FIG. 3 will include entrained lubricant. Some of the lubricant will coat the inside wall of the lubrication passage 94. One or more radial passages 116 in the crank pin 78 will allow lubricant on the wall of lubrication passage 94 to lubricate the bearing surfaces on the crank pin 78 and in the bore 87 through the eccentric bushing 80. Centrifugal force will cause lubricant to flow to the radial passage 116 and to the bore 87 if the radial passage 116 is positioned in the crank pin 78 so that lubricant flows away from the axis of rotation of the crank shaft 74 when it enters the radial passage 116.

The invention has been described in detail in connection with preferred embodiments. It will be understood by those skilled in the art that the invention can be used in fluid expanders and pumps as well as in compressors and that other variations and modifications can be made which are within the scope of the invention.

We claim:

1. A scroll type fluid compressor having a housing with a front section and a rear section; a fluid inlet in the housing, a fluid outlet in the housing, a fixed scroll with an end plate, the end plate having a forward wall, a spiral wrap and a central discharge aperture in the end plate, mounted in the rear section of the housing; an orbital scroll with an end plate and a spiral wrap cooperating with the fixed scroll to form fluid pockets; a rotation prevention assembly mounted in the housing which prohibits rotation and allows orbital movement of the orbital scroll; an orbital scroll drive including a crankshaft with an integral disk and an eccentric crank pin rotatably supported in the front section of the housing, a boss on the forward wall of the end plate of the orbital scroll, a bore in the boss, an eccentric bushing journaled by a bearing in the bore in the boss on the orbital scroll and closing a cavity formed by the bore, and an aperture in the eccentric bushing which receives the crankshaft crank pin; a cavity in the front section of the housing forming a crankcase that is in communication with the fluid inlet port; a lubrication passage through the crank pin which allows fluid and entrained lubricant to pass from the crankcase to the bore on the orbital scroll in which the eccentric bushing is journaled; and a scoop on one end of the lubrication passage through the crank pin operable to pick up lubricant and fluid in the crankcase and force the lubricant and fluid into the bore on the orbital scroll.

* * * * *